US009221284B2

(12) United States Patent
Okada et al.

(10) Patent No.: US 9,221,284 B2
(45) Date of Patent: Dec. 29, 2015

(54) IMAGE FORMING APPARATUS, METHOD FOR FORMING TEST PATTERN, AND COMPUTER PROGRAM PRODUCT

(71) Applicants: Tatsuhiko Okada, Kanagawa (JP); Mamoru Yorimoto, Kanagawa (JP); Daisaku Horikawa, Kanagawa (JP); Yuichi Sakurada, Tokyo (JP); Makoto Moriwaki, Kanagawa (JP)

(72) Inventors: Tatsuhiko Okada, Kanagawa (JP); Mamoru Yorimoto, Kanagawa (JP); Daisaku Horikawa, Kanagawa (JP); Yuichi Sakurada, Tokyo (JP); Makoto Moriwaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/094,576

(22) Filed: Dec. 2, 2013

(65) Prior Publication Data

US 2014/0152737 A1 Jun. 5, 2014

(30) Foreign Application Priority Data

Dec. 5, 2012 (JP) ..... 2012-266771
Oct. 11, 2013 (JP) ..... 2013-213846

(51) Int. Cl.
*B41J 29/393* (2006.01)
*B41J 29/38* (2006.01)
*B41J 2/12* (2006.01)

(52) U.S. Cl.
CPC *B41J 29/393* (2013.01); *B41J 2/12* (2013.01); *B41J 29/38* (2013.01); *B41J 2029/3935* (2013.01)

(58) Field of Classification Search
CPC ..... B41J 29/393; B41J 2/13; B41J 2029/393; B41J 2029/395; B41J 2202/38
USPC ..... 347/9, 14, 19
See application file for complete search history.

(56) References Cited

U.S. PATENT DOCUMENTS

| | | | | |
|---|---|---|---|---|
| 6,082,911 | A * | 7/2000 | Murakami | 400/74 |
| 6,084,606 | A | 7/2000 | Moriyama | |
| 6,547,360 | B2 * | 4/2003 | Takahashi et al. | 347/19 |
| 6,700,593 | B2 * | 3/2004 | Otsuki | 346/19 |
| 6,886,904 | B2 | 5/2005 | Otsuki | |
| 7,296,877 | B2 | 11/2007 | Chikuma et al. | |
| 7,318,636 | B2 * | 1/2008 | Komatsu | 347/19 |
| 7,393,312 | B2 | 7/2008 | Rousseau | |
| 2008/0018701 | A1 | 1/2008 | Lee | |

FOREIGN PATENT DOCUMENTS

| | | | | |
|---|---|---|---|---|
| CN | 1636715 | A | 7/2005 | |
| CN | 1736729 | A | 2/2006 | |
| CN | 101204888 | A | 6/2008 | |
| EP | 0589718 | A1 * | 3/1994 | B41J 2/01 |
| JP | 2000127370 | | 5/2000 | |
| JP | 2001334643 | | 12/2001 | |
| JP | 3560305 | | 6/2004 | |
| JP | 2004-358759 | | 12/2004 | |

* cited by examiner

*Primary Examiner* — Jannelle M Lebron
*Assistant Examiner* — Jeremy Bishop
(74) *Attorney, Agent, or Firm* — Duft Bornsen & Fettig LLP

(57) ABSTRACT

An image forming apparatus includes a recording head in which a plurality of nozzles for discharging liquid droplets; and a pattern forming unit configured to form a test pattern used for positional deviation adjustment including a first pattern serving as a reference pattern and a second pattern serving as an adjustment pattern. The first pattern and the second pattern each are a linear pattern that is parallel to a nozzle arrangement direction and has a disconnected portion. The disconnected portion of the first pattern and the disconnected portion of the second pattern are shifted from each other in the nozzle arrangement direction.

9 Claims, 10 Drawing Sheets

IMAGE FORMING APPARATUS, METHOD FOR FORMING TEST PATTERN, AND COMPUTER PROGRAM PRODUCT

CROSS-REFERENCE TO RELATED APPLICATIONS

The present application claims priority to and incorporates by reference the entire contents of Japanese Patent Application No. 2012-266771 filed in Japan on Dec. 5, 2012 and Japanese Patent Application No. 2013-213846 filed in Japan on Oct. 11, 2013.

BACKGROUND OF THE INVENTION

1. Field of the Invention

The present invention relates to an image forming apparatus, a method for forming a test pattern, and a computer program product.

2. Description of the Related Art

Image forming apparatuses include printers, facsimiles, copying machines, plotters, and multifunctional peripherals of these. For example, an inkjet recording apparatus and the like are known as image forming apparatuses of liquid discharge recording system which use a recording head(s) including a liquid discharge head(s) (liquid droplet discharge head(s)) for discharging liquid droplets.

Some image forming apparatuses form an image by using recording heads mounted on a reciprocating carriage. Such image forming apparatuses are prone to cause positional deviations of ruled lines between a forward path and a backward path in two-directional printing, and positional deviations due to a physical displacement between a plurality of heads in the case of one-way printing.

As a measure against this, for example, it is known to print a test pattern for adjusting impact positions of liquid droplets on a medium to be recorded and adjust or select droplet discharge timing based on the printed test pattern.

For example, the droplet discharge timing may conventionally be adjusted by printing linear reference patterns and linear adjustment patterns, and inputting a numerical value or the like corresponding to not-deviating ones of the reference patterns and the adjustment patterns by visual observation (Japanese Laid-open Patent Publication No. 10-264485).

When linear patterns are used as the test pattern for positional deviation adjustment as described above, there is a problem of poor visibility if the reference patterns and the adjustment patterns are formed to be simply joined or overlap each other.

Therefore, there is a need for an image forming apparatus and a method for forming a test pattern that are capable of improving the visibility of a test pattern formed by linear patterns.

SUMMARY OF THE INVENTION

According to an embodiment, an image forming apparatus includes a recording head in which a plurality of nozzles for discharging liquid droplets; and a pattern forming unit configured to form a test pattern used for positional deviation adjustment including a first pattern serving as a reference pattern and a second pattern serving as an adjustment pattern. The first pattern and the second pattern each are a linear pattern that is parallel to a nozzle arrangement direction and has a disconnected portion. The disconnected portion of the first pattern and the disconnected portion of the second pattern are shifted from each other in the nozzle arrangement direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
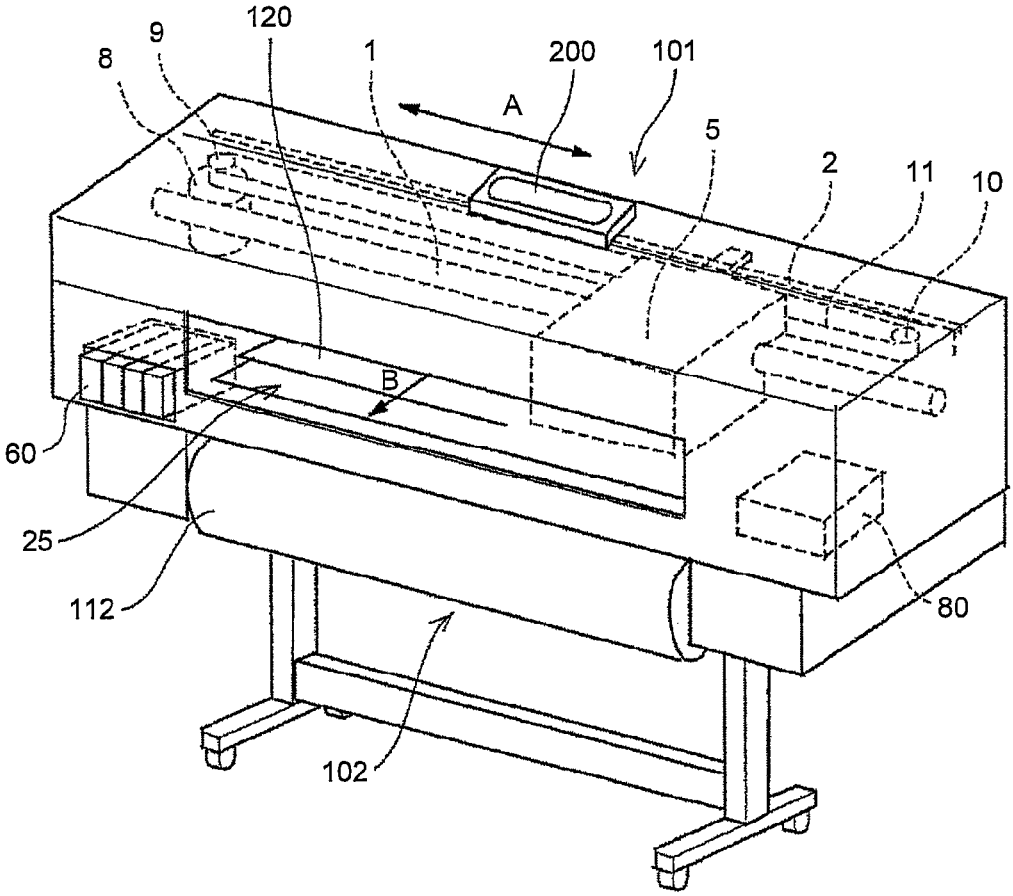
FIG. 1 is an explanatory perspective view illustrating the appearance of an example of an image forming apparatus according to the present invention.
Figure 2:
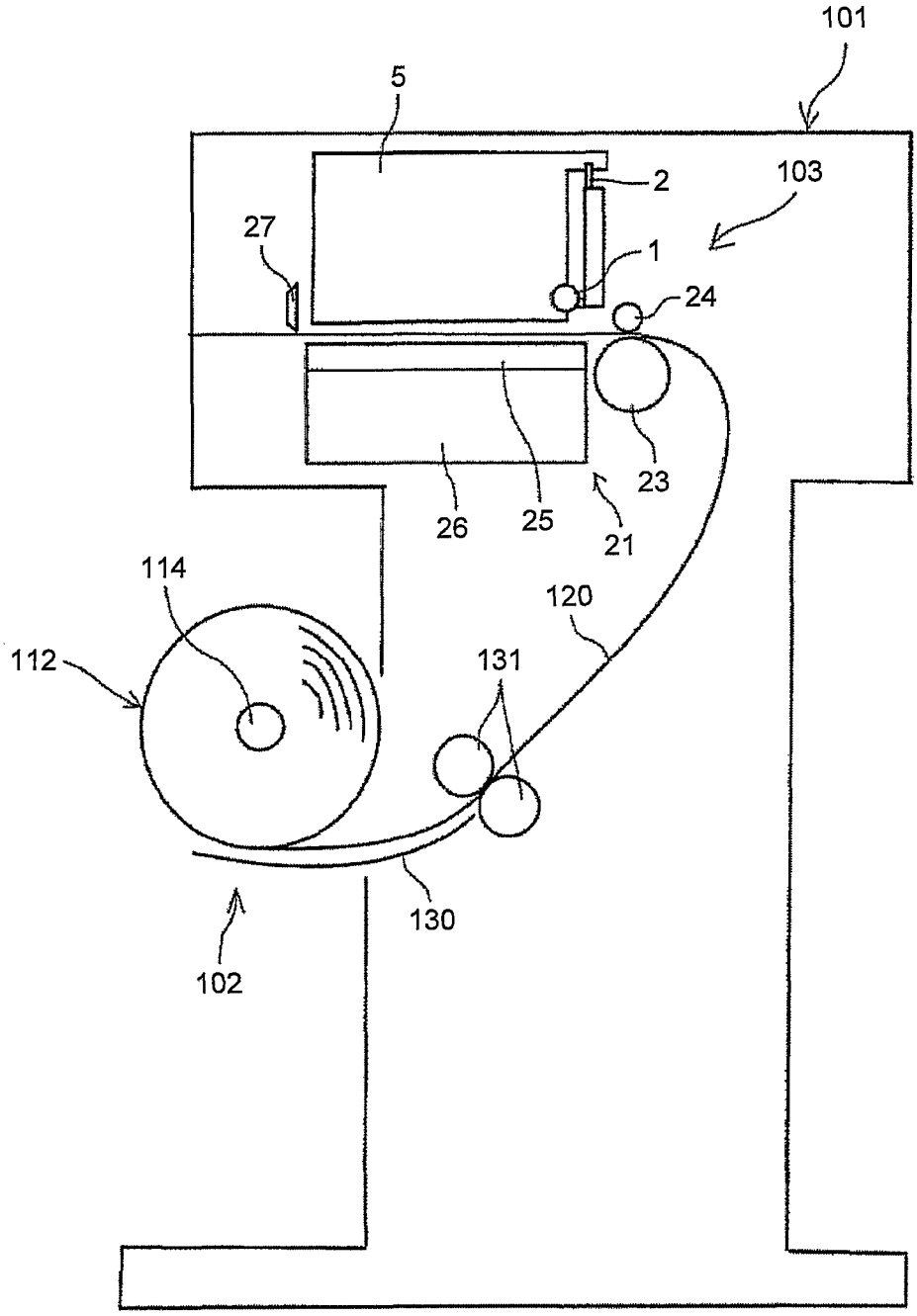
FIG. 2 is a schematic explanatory side view of the apparatus.
Figure 3:
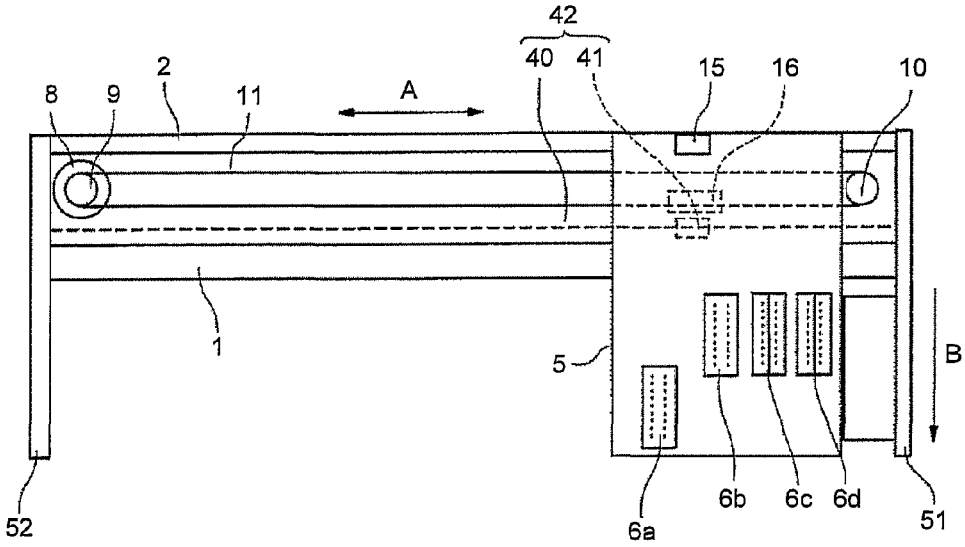
FIG. 3 is an explanatory plan view illustrating essential parts of an image forming unit of the apparatus.

Embodiments of the present invention will be described below with reference to the accompanying drawings. An example of an image forming apparatus according to the present invention will be described with reference to FIGS. 1 to 3. FIG. 1 is an explanatory perspective view illustrating the appearance of the image forming apparatus. FIG. 2 is a schematic explanatory side view of the same. FIG. 3 is an explanatory plan view illustrating essential parts of an image forming unit of the same.

The image forming apparatus illustrated in FIGS. 1 to 3 is a serial-type image apparatus, and includes an apparatus main body 101 and a paper feeding device 102 arranged below the apparatus main body 101. The paper feeding device 102 is separate from the apparatus main body 101 and arranged below the apparatus main body 101. FIG. 2 illustrates an example where the apparatus main body 101 and the paper feeding device 102 are integrally arranged.

A print mechanism 103 is arranged inside the apparatus main body 101. The print mechanism 103 is an image forming unit that forms an image on roll paper 120 which is a rolled medium fed from the paper feeding device 102.

In the print mechanism 103, a guide rod 1 and a guide stay 2 serving as guide members are laid between both side plates 51 and 52. A carriage 5 is held by the guide rod 1 and the guide stay 2 so as to be movable in the direction of the arrow A (main-scanning direction, carriage movement direction). A sub guide receptacle 15 is movably engaged with the guide stay 2.

A main-scanning motor 8 serving as a driving source for reciprocating the carriage 5 is arranged on one side in the main-scanning direction. The main-scanning motor 8 drives a driving pulley 9. A timing belt 11 is laid across the driving pulley 9 and a driven pulley 10 which is arranged on the other side in the main-scanning direction. A belt holding unit 16 of the carriage 5 is fixed to the timing belt 11. The main-scanning motor 8 is driven to reciprocate the carriage 5 in the main-scanning direction.

The carriage 5 includes a plurality of (in the present embodiment, four) recording heads 6*a* to 6*d* (referred to as "recording heads 6" when no distinction is made). The recording heads 6 each include a liquid discharge head and a head tank for supplying liquid to the head, which are integrally provided.

The recording head 6*a* is arranged shifted from positions of the recording heads 6*b* to 6*d* by one head (one nozzle row) in a sub-scanning direction which is a direction orthogonal to the main-scanning direction. The recording heads 6 are mounted so that nozzle rows including a plurality of nozzles for discharging liquid droplets are arranged in the sub-scanning direction orthogonal to the main-scanning direction, with the droplet discharge direction downward.

The recording heads 6*a* to 6*d* include two nozzle rows each. The recording heads 6*a* and 6*b* discharge black (K) liquid droplets from both of the nozzle rows. The recording head 6*c* discharges cyan (C) liquid droplets from either one of the nozzle rows. The other nozzle row is unused. The recording head 6*d* discharges yellow (Y) liquid droplets from either one of the nozzle rows, and magenta (M) liquid droplets from the other.

Consequently, a monochrome image can be formed by using the recording heads 6*a* and 6*b* in a width of two heads by each scan (main scan). A color image can be formed, for example, by using the recording heads 6*b* to 6*d*. Note that the head configuration is not limited to the foregoing, and the plurality of recording heads may be all arranged in a row in the main-scanning direction.

Ink cartridges serving as main tanks are replaceably attached to the apparatus main body 101. The ink cartridges supply inks of respective colors to the head tanks of the recording heads 6 via supply tubes.

An encoder sheet 40 is arranged in a moving direction of the carriage 5. An encoder sensor 41 for reading the encoder sheet 40 is provided on the carriage 5. The encoder sheet 40 and the encoder sensor 41 constitute a linear encoder 42. The position and speed of the carriage 5 are detected from the output of the linear encoder 42.

The paper feeding device 102 feeds the roll paper 120 to a recording area in a main-scanning area of the carriage 5. A conveyance unit 21 intermittently conveys the roll sheet 120 in a direction orthogonal to the main-scanning direction of the carriage 5 (sub-scanning direction, sheet conveyance direction; the direction of the arrow B).

The conveyance unit 21 includes a conveyance roller 23 and a pressure roller 24. The conveyance roller 23 conveys the roll paper 120 which is the rolled medium fed from the paper feeding device 102. The pressure roller 24 is opposed to the conveyance roller 23. The conveyance unit 21 further includes a conveyance guide member 25 and a suction fan 26 which are arranged on the downstream side of the conveyance roller 23. The conveyance guide member 25 has a plurality of suction holes. The suction fan 26 serves as suction means for sucking in through the suction holes of the conveyance guide member 25.

As illustrated in FIG. 2, a cutter 27 is arranged on the downstream side of the conveyance unit 21. The cutter 27 serves as cutting means for cutting the roll paper 120 on which an image is formed by the recording heads 6 to a predetermined length.

A maintenance and recovery mechanism 80 is arranged on one side in the main-scanning direction of the carriage 5, beside the conveyance guide member 25. The maintenance and recovery mechanism 80 performs maintenance and recovery of the recording heads 6.

The paper feeding device 102 includes a roll body 112. The roll body 112 refers to a long rolled medium or sheet (as mentioned above, which is referred to as "roll paper") 120 wound in a roll around a pipe 114 serving as a core member. In the present embodiment, the end of the roll paper 120 may be fixed to the pipe 114 by adhesion such as gluing. The end of the roll paper 120 may not be fixed to the pipe 114 by adhesion such as gluing. Both may be mounted as a roll body 112.

The apparatus main body 101 includes a guide member 130 and a conveyance roller pair 131. The guide member 130 guides the roll paper 120 drawn out of the roll body 112. The conveyance roller pair 131 curves and feeds the roll paper 120 upward.

When the conveyance roller pair 131 is driven to rotate, the roll paper 120 unrolled from the roll body 112 is conveyed as stretched between the conveyance roller pair 131 and the roll body 112. The roll paper 120 is then passed through the conveyance roller pair 131 and fed into between the conveyance roller 23 and the pressure roller 24 of the conveyance unit 21.

With such a configuration, the image forming apparatus moves the carriage 5 in the main-scanning direction and intermittently feeds the roll paper 120 fed from the paper feeding device 102 by using the conveyance unit 21. The recording heads 6 are driven to discharge liquid droplets according to image information (print information), whereby a desired image is formed on the roll paper 120. The roll paper 120 having the image formed thereon is cut to a predetermined length by the cutter 27. The cut paper is guided by a not-illustrated paper discharge guide member arranged on the front side of the apparatus main body 101, and discharged and stored into a bucket.

Figure 4:
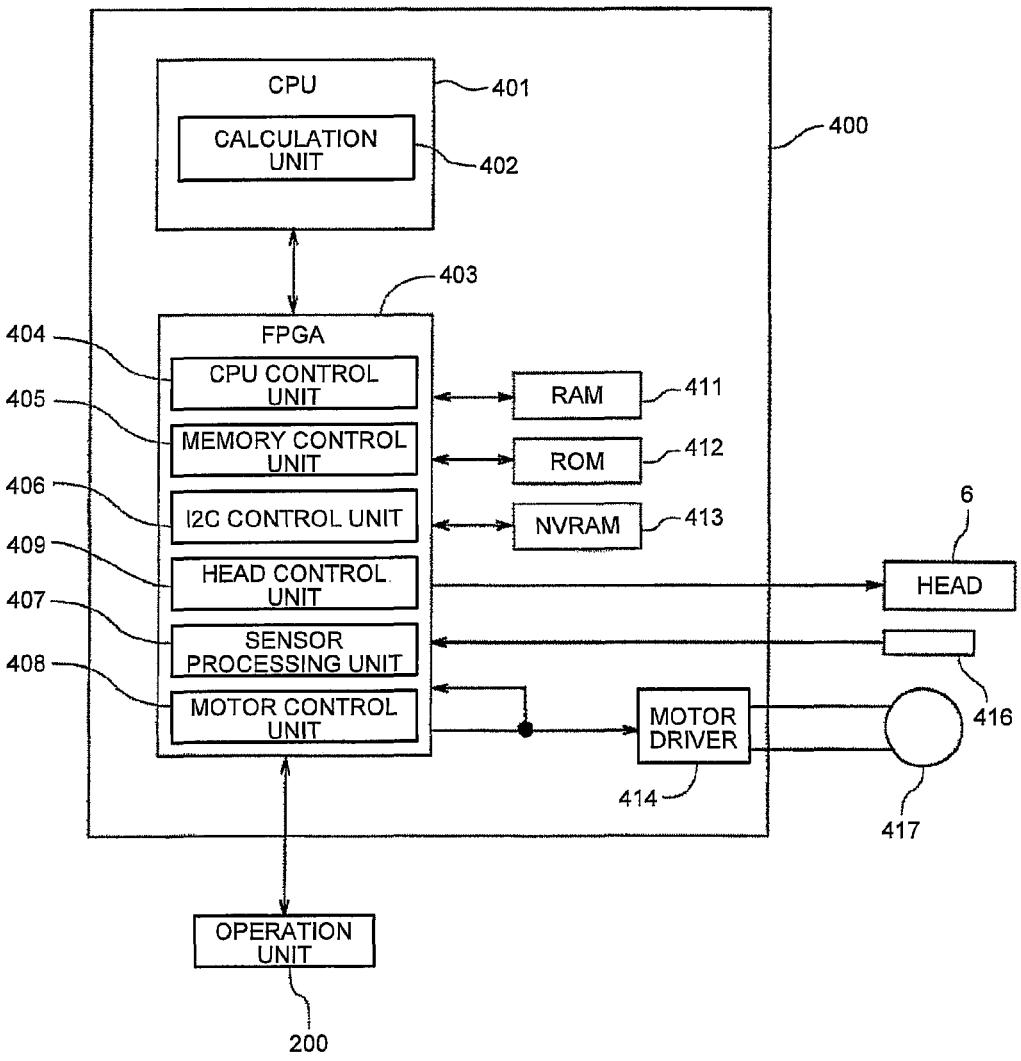
FIG. 4 is an explanatory block diagram for providing an overview of a control unit of the apparatus.

Next, a control unit of the image forming apparatus will be overviewed with reference to the explanatory block diagram of FIG. 4.

A control unit 400 includes a CPU 401, a field programmable gate array (FPGA) 403, a RAM 411, a ROM 412, an NVRAM 413, and a motor driver 414.

The CPU 401 includes a calculation unit 402 which performs communication with the respective components of the FPGA 403.

The FPGA 403 includes a CPU control unit 404, a memory control unit 405, an I2C control unit 406, and a head control unit 409. The CPU control unit 404 performs communication with the CPU 401. The memory control unit 405 is intended to access memories such as the ROM 412 and the RAM 411. The I2C control unit 406 performs communication with the NVRAM 413. The head control unit 409 performs drive control on the recording heads 6.

The FPGA 403 further includes a sensor processing unit 407. The sensor processing unit 407 processes sensor signals of a temperature and humidity sensor, encoder sensors 416, etc. The temperature and humidity sensor is a sensor for detecting the ambient temperature and ambient humidity of the apparatus. The sensor processing unit 407 also serves as a unit for generating a position signal and a speed signal of the carriage 5 from an output signal of the linear encoder 42, and a unit for generating a position signal and a speed signal of the conveyance roller 23 from an output signal of a rotary encoder of the conveyance unit 21.

The FPGA 403 further includes a motor control unit 408 which drives and controls various motors 417 including the main-scanning motor 8.

The encoder sensors 416 include the encoder sensor 41 of the linear encoder 42 for detecting the position and speed of the carriage 5 described above, and an encoder sensor that constitutes the not-illustrated rotary encoder for detecting the amount of rotation and the like of the conveyance roller 23.

The motors 417 include, in addition to the main-scanning motor 8, a sub-scanning motor for driving the conveyance roller 23 to rotate and a paper feeding motor for rotating the conveyance roller pair 131 and the like to rotate. For example, DC motors, stepping motors, and the like may be used as the motors.

When forming a test pattern, the head control unit 409 reads test pattern data which is stored and retained in the ROM 412 in advance. The head control unit 409 then drives and controls the recording heads 6 to form the test pattern on a medium to be recorded (here, the roll paper 120).

When the test pattern formed on the medium to be recorded is visually observed and a numerical value or the like corresponding to a pattern without deviation is input through an operation unit 200, the head control unit 409 adjusts droplet discharge timing. In the present embodiment, as illustrated in FIG. 1, the operation unit 200 is arranged on the top of the apparatus main body 101.

The control unit 400 constitutes a pattern forming unit according to the present invention.

Figure 5:
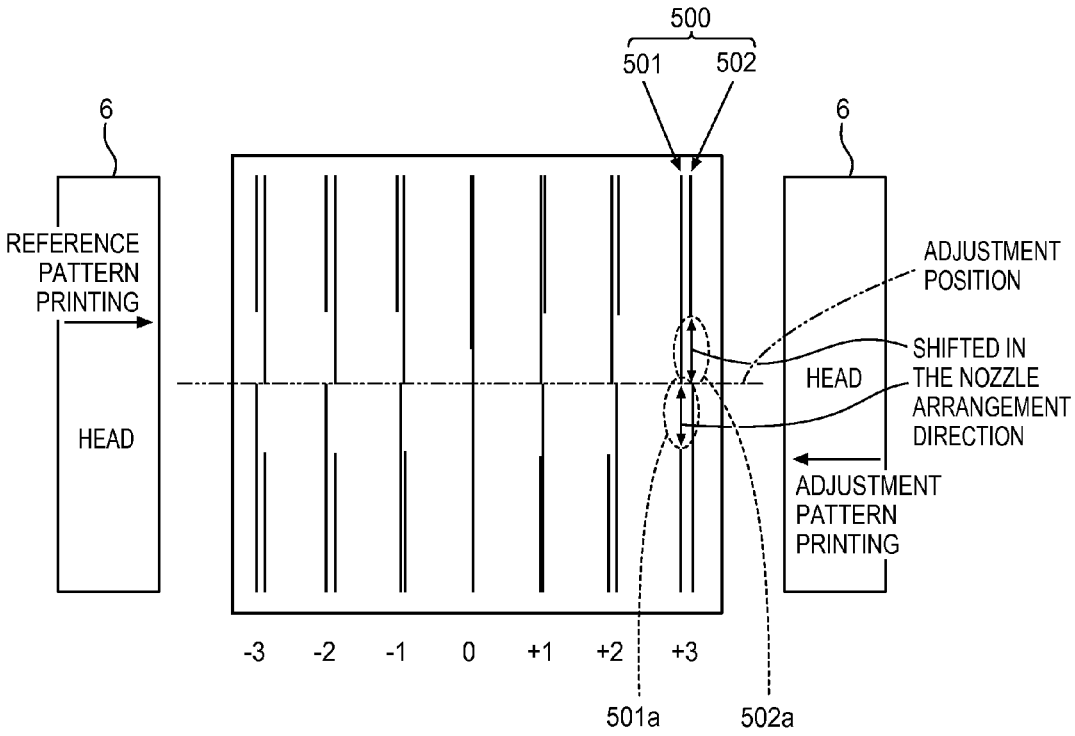
FIG. 5 is an explanatory diagram for describing an example of a test pattern for positional deviation adjustment.
Figure 6:
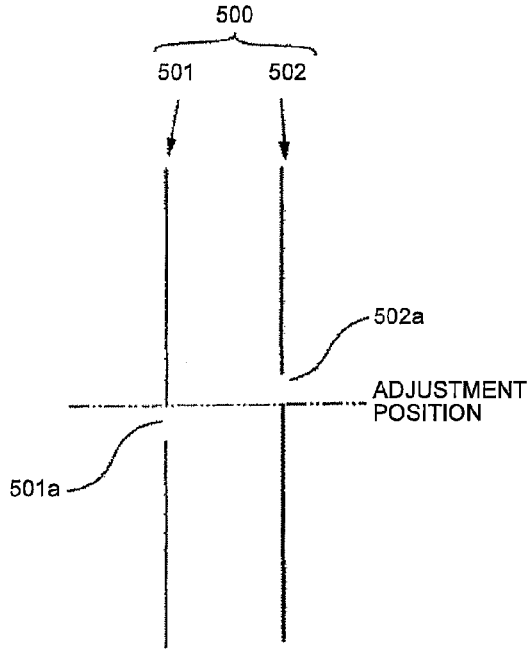
FIG. 6 is an enlarged explanatory diagram illustrating essential parts of the test pattern.

Next, a test pattern for positional deviation adjustment will be described with reference to FIGS. 5 and 6. FIG. 5 is an explanatory diagram for describing the test pattern. FIG. 6 is an enlarged explanatory diagram illustrating essential parts of FIG. 5.

The test pattern 500 used for positional deviation adjustment according to the present invention includes a first pattern 501 serving as a reference pattern and a second pattern 502 serving as an adjustment pattern.

The first pattern 501 is a linear pattern parallel to a nozzle arrangement direction and having a disconnected portion 501*a*. The second pattern 502 is a linear pattern parallel to the nozzle arrangement direction and having a disconnected portion 502*a*. The disconnected portion 501*a* of the first pattern 501 and the disconnected portion 502*a* of the second pattern 502 are arranged to be shifted in the nozzle arrangement direction. The "portions 501*a* and 502*a*" may also be referred to as "not-printed portions" or "unused nozzle portion."

The disconnected portion 501*a* of the first pattern 501 is arranged near a desired adjustment position (adjustment target position). Similarly thereto, the disconnected portion 502*a* of the second pattern 502 is arranged somewhat near the desired adjustment position.

The first and second patterns 501 and 502 are formed so that the disconnected portion 501*a* of the first pattern 501 and the disconnected portion 502*a* of the second pattern 502 are shifted from each other in the nozzle arrangement direction.

In the example of FIGS. 5 and 6, the first pattern 501 serving as the reference pattern is a line pattern having the unused nozzle portion (disconnected portion 501*a*) at a position below a positional deviation adjustment position (in this example, the center of the head in the nozzle arrangement direction).

The second pattern 502 serving as the adjustment pattern is obtained by rotating the first pattern 501 (reference pattern) by 180° about the adjustment position. That is, in FIGS. 5 and 6, the unused nozzle portion (disconnected portion 502*a*) positions above the adjustment position.

In other words, the disconnected portion 501*a* of the first pattern 501 and the disconnected portion 502*a* of the second pattern 502 are formed to be juxtaposed on opposite sides with the desired adjustment position therebetween in the nozzle arrangement direction.

The first pattern 501 and the second pattern 502 may be replaced with each other. The not-printed portion (disconnected portion) may be arbitrarily set. The not-printed portions (disconnected portions) desirably have the same length of around 1 mm to 3 mm because too small or too large lengths may deteriorate visibility.

The use of such a test pattern 500 can facilitate the visual identification of the location of the joint position, and allows a determination based on the degree of overlapping and line thickness as well. This can improve the visibility of the test pattern formed of linear patterns, and by extension improve the adjustment accuracy.

In FIG. 5, for example, the test pattern 500 is visually observed to determine a pattern having the smallest amount of deviation. Any one of the numerical values "−3" to "0" to "+3" corresponding to the pattern is input, and the control unit 400 performs control to correct the droplet discharge timing. In the example of FIG. 5, the pattern corresponding to "0" has the smallest amount of deviation and thus, "0" is input.

Here, test patterns according to Comparative Examples 1 and 2 is described with reference to FIGS. 7 and 8.

Figure 7:
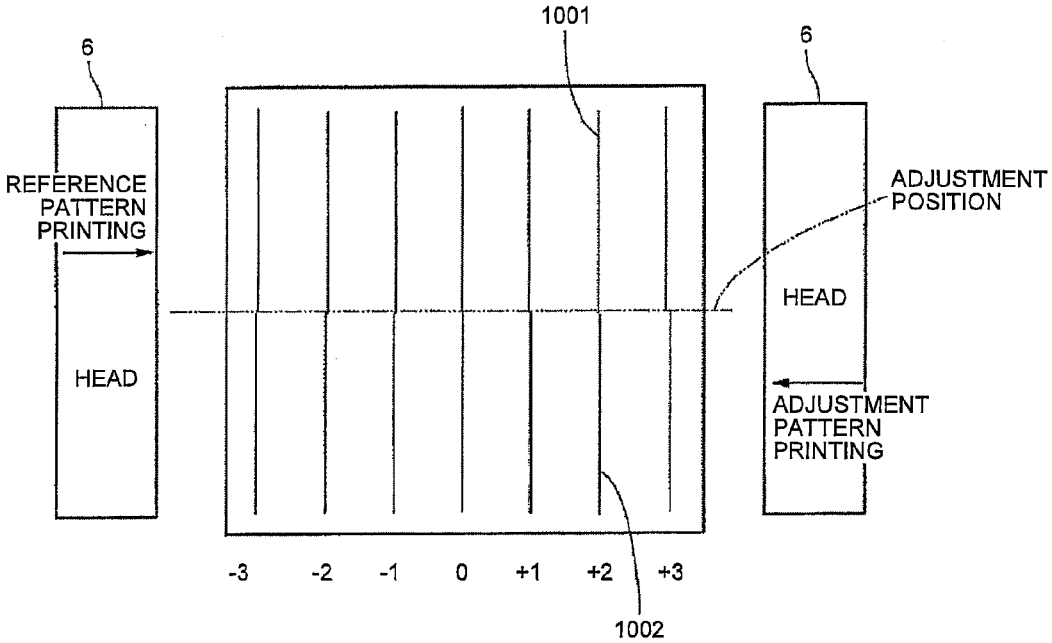
FIG. 7 is an explanatory diagram for describing a test pattern according to Comparative Example 1.

FIG. 7 illustrates a test pattern according to Comparative Example 1. A reference pattern 1001 and an adjustment pattern 1002 are formed by printing in respective different areas with the adjustment position (in this example, the head center) therebetween.

With the test pattern according to Comparative Example 1, a positional deviation is determined from the degree of deviation at the joint portion between the reference pattern 1001 and the adjustment pattern 1002.

Figure 8:
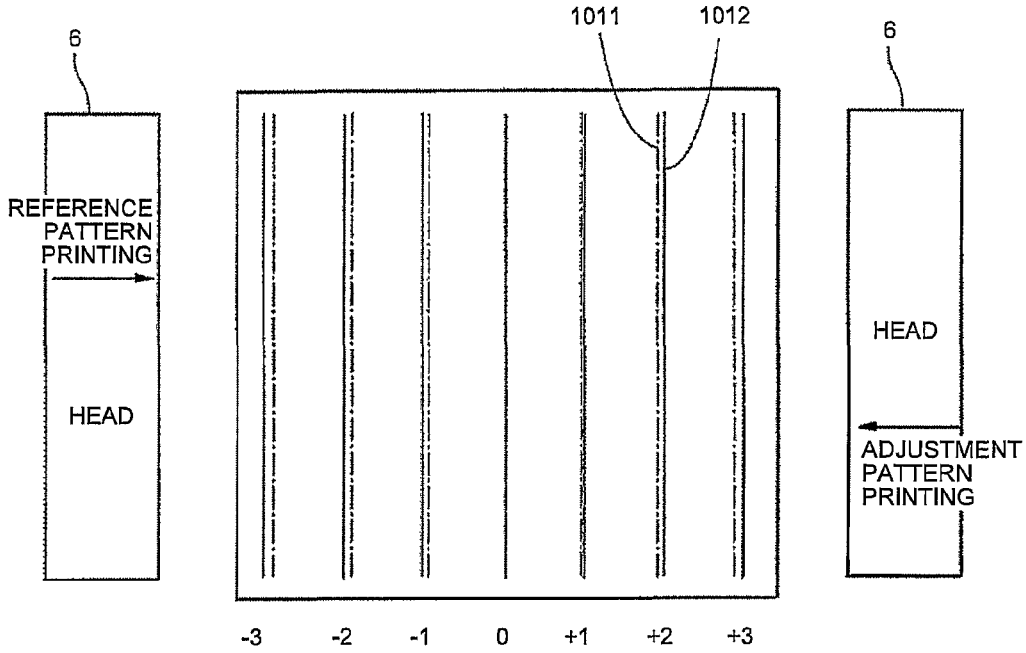
FIG. 8 is an explanatory diagram for describing a test pattern according to Comparative Example 2.

FIG. 8 illustrates a test pattern according to Comparative Example 2. A reference pattern 1011 and an adjustment pattern 1012 are formed, for example, by using all the nozzles of the head.

With the test pattern according to Comparative Example 2, a positional deviation is determined from the degree of overlapping or the line thickness of the reference pattern 1011 and the adjustment pattern 1012.

If the patterns are simply joined or simply overlapped as in Comparative Examples 1 and 2, the visibility is poor and the adjustment accuracy is insufficient.

In contrast, the test pattern according to the present embodiment includes the not-printed portions near the adjustment position. This makes the joint position more visible, and allows a determination based on the degree of overlapping and the line thickness as well for improved visibility.

Next, another example of the test pattern will be described.

In the foregoing example, the test pattern 500 is formed by using all the nozzles except those corresponding to the disconnected portions 501*a* and 502*a*. However, a test pattern may be formed by using only nozzles near those corresponding to the disconnected portions 501*a* and 502*a*.

Such a test pattern is predicated on that a droplet discharge speed Vj (ink impact position) will not vary with the number of nozzles used. In other words, if the image forming apparatus has the characteristic that the droplet discharge speed Vj varies with the number of nozzles used (referred to as "single/multi characteristic"), the test pattern is created according to the number of nozzles used.

Figure 9:
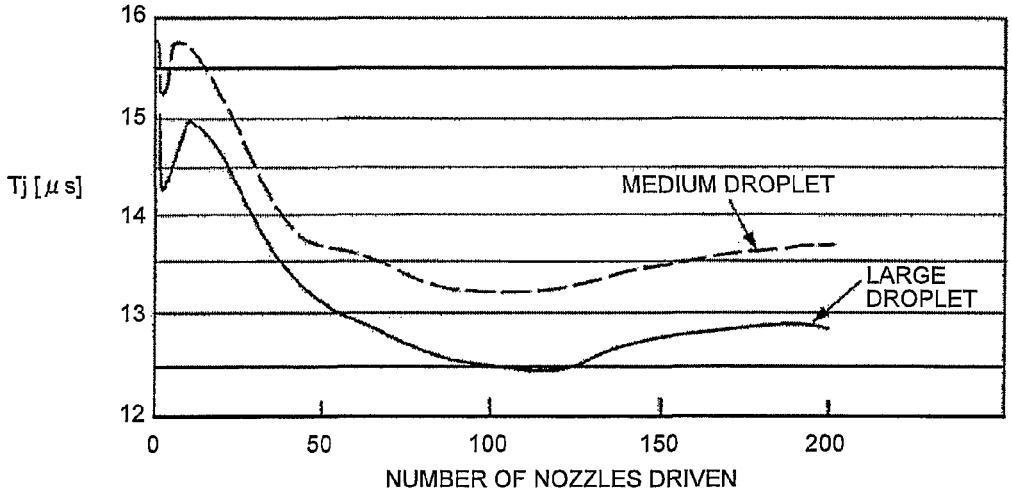
FIG. 9 is an explanatory diagram for describing a relationship between the number of nozzles used and a droplet discharge speed (single/multi characteristic).

FIG. 9 illustrates an example where the droplet discharge speed varies with the number of nozzles. In FIG. 9, although the time to impact Tj is illustrated instead of the droplet discharge speed Vj, the correlation with the number of nozzles is the same.

For example, to make an adjustment for ruled lines of drawings and the like, nozzles in almost the entire area may be used to form patterns. For halftones and the like, the nozzles in the entire area may be used, whereas the nozzles to be used are thinned out to reduce the total number of nozzles to use.

Suppose that a joint pattern like Comparative Example 1 is formed in the presence of the foregoing single/multi characteristic. As illustrated in section (a) of FIG. 10, a reference pattern 1001 and an adjustment pattern 1002 use different numbers of nozzles depending on the adjustment position. As a result, the joint pattern is affected by the single/multi characteristic.

Figure 10:
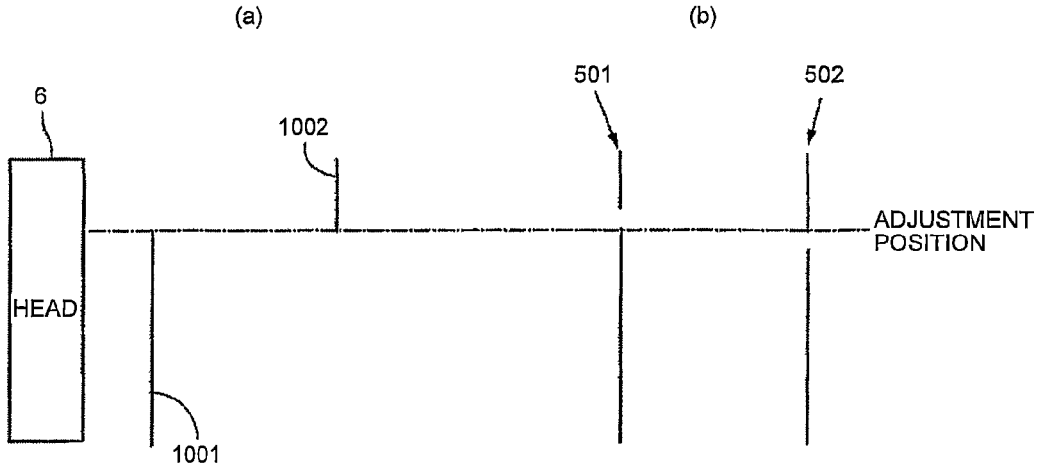
FIG. 10 is an explanatory diagram for describing a relationship between the single/multi characteristic and the test patterns of Comparative Example 1 and the embodiment.

In contrast, as illustrated in section (b) of FIG. 10, the test pattern according to the present embodiment includes the first pattern (reference pattern) 501 and the second pattern (adjustment pattern) 502 which use the same number of nozzles. This provides the advantage of being insusceptible to the single/multi characteristic even if the adjustment position is changed.

The test pattern according to the present embodiment is applicable even if the image forming apparatus feeds a sheet in the sub-scanning direction and has the single/multi characteristic.

Figure 11:
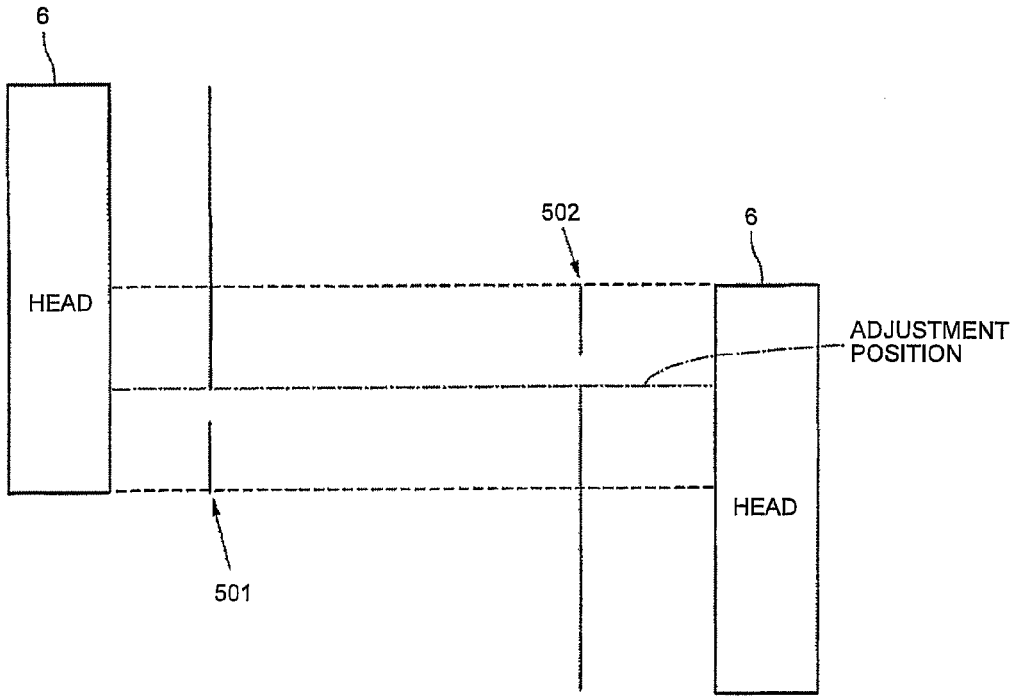
FIG. 11 is an explanatory diagram for describing pattern formation in a print mode in which head performs printing in an overlapping manner in a nozzle arrangement direction.

As illustrated in FIG. 11, pattern formation can be performed even in such a print mode that the head performs printing in a half-overlapping manner in the sub-scanning direction (nozzle arrangement direction).

In such a case, the head 6 forms the first pattern (reference pattern) 501 and then, the head 6 is relatively moved in the sub-scanning direction (nozzle arrangement direction) to form the second pattern (adjustment pattern) 502.

Consequently, the first pattern (reference pattern) 501 and the second pattern (adjustment pattern) 502 are formed to be shifted in the nozzle array direction. The test pattern is thus applicable even in the print mode in which the head performs printing in an overlapping manner in the sub-scanning direction (nozzle arrangement direction).

Figure 12:
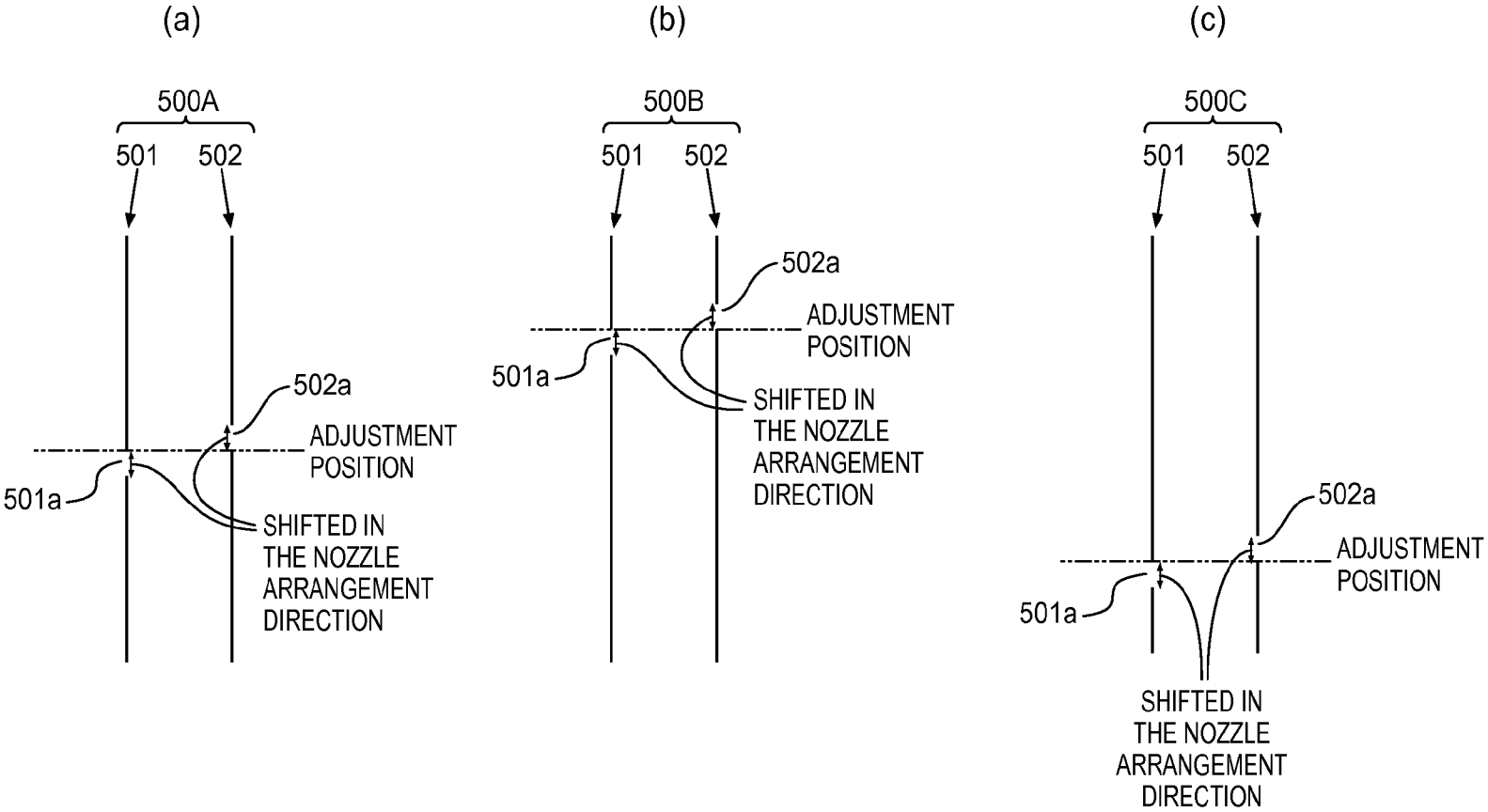
FIG. 12 is an explanatory diagram for describing another embodiment of the present invention.

Next, another embodiment of the present invention will be described with reference to FIG. 12. FIG. 12 is an explanatory diagram for describing the embodiment.

In the present embodiment, as illustrated in sections (a) to (C) of FIG. 12, pattern data on a plurality of test patterns 500A to 500C is stored in the ROM 412 or other storage unit as pattern data on a test pattern 500.

The test patterns 500A to 500C include a plurality of first patterns 501 and second patterns 502 which are mutually different in position of disconnected portion 501*a* and 502*a* in the nozzle arrangement direction.

The operation unit 200 selects any one of the test patterns 500A to 500C to use, so that the selected test pattern 500 is formed.

As described above, the disconnected portions 501*a* and 502*a* are arranged on opposite sides in the nozzle arrangement direction with an adjustment position therebetween. Thus, the adjustment position is selectable to change the test pattern 500A, 500B, or 500C to be used.

In such a manner, the test pattern to be used is selectable to change the adjustment position to a desired position.

Figure 13:
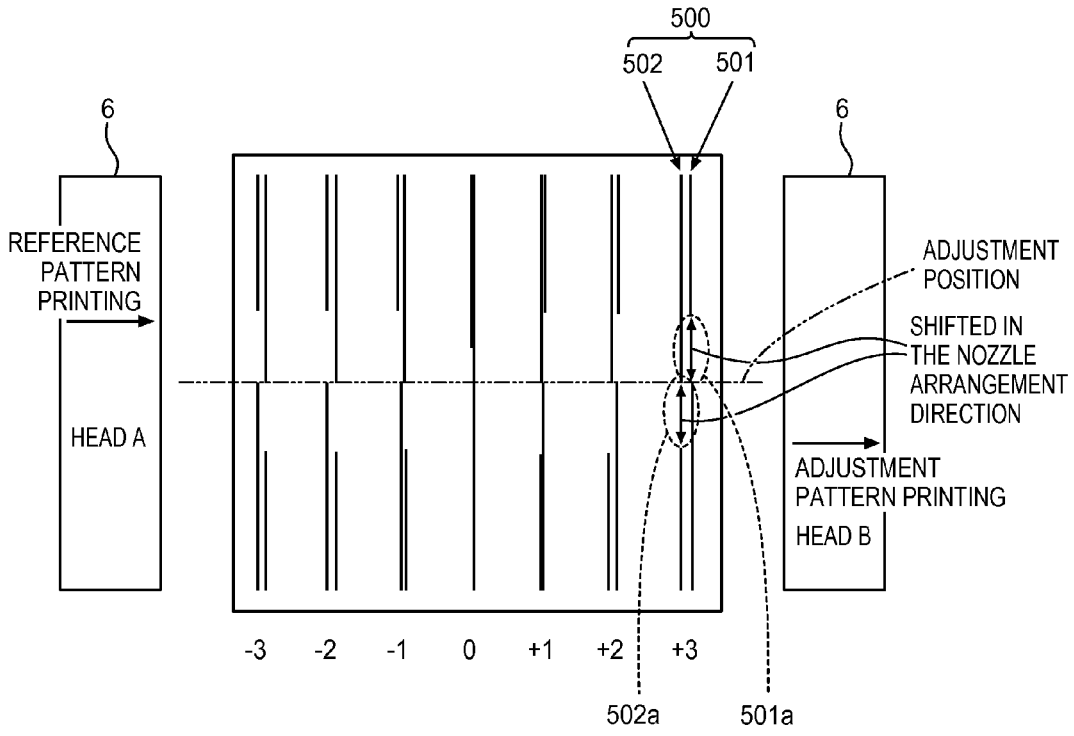
FIG. 13 is an explanatory diagram for describing yet another embodiment of the present invention.

Next, yet another embodiment of the present invention will be described with reference to FIG. 13. FIG. 13 is an explanatory diagram for describing the embodiment.

In the present embodiment, a first pattern (reference pattern) 501 is a line pattern having at a position above the adjustment position (in this example, the center of the head in the nozzle arrangement direction).

A second pattern (adjustment pattern) 502 is a linear pattern obtained by rotating the first pattern (reference pattern) 501 by 180° about the adjustment position. In other words, the unused nozzle portion (disconnected portion 502*a*) positions below the adjustment position.

The relationship between the reference pattern and the adjustment pattern may be reversed.

The first pattern 501 is formed by using a head A. The second pattern 502 is formed by using a head B. That is, the reference pattern and the adjustment pattern are formed by using the different heads. During pattern formation, the heads A and B move in the same direction.

Although the not-printed portions (unused nozzle portions) may be arbitrarily set, the not-printed portions desirably have the same length of around 1 mm to 3 mm because too small or too large lengths may deteriorate visibility.

The use of the reference pattern and the adjusting pattern according to the present embodiment makes the joint position therebetween visible, and allows a determination based on the degree of overlapping thereof and the line thickness as well for improved visibility, and by extension improves the accuracy. Since the reference pattern and the adjustment pattern are 180° rotated from each other, the stored pattern data may be of only one pattern. This reduces the memory capacity and simplifies the configuration.

In the foregoing embodiment, a computer (CPU) performs processing related to the control of the main-scanning motor in accordance with a program stored in the ROM or the like. The program may be stored and provided in a recording medium. The program may be provided by downloading through a network such as the Internet.

As employed herein, a "sheet" is not limited to ones made of paper but may include an OHP sheet, cloth, glass, and a substrate to which ink droplets or other liquid can adhere. Sheets may include what are referred to as a medium to be recorded, a recording medium, recording paper, and a recording sheet. Image formation, recording, print, imaging, and printing are all synonymous.

An "image forming apparatus" refers to an apparatus that performs image formation by discharging a liquid to a medium such as paper, strings, fibers, fabric cloth, leather, metal, plastic, glass, wood, and ceramic. "Image formation" not only refers to providing a medium with an image that means a character(s) and/or figure(s), but also refers to providing a medium with a pattern or other meaningless image (simply making a liquid droplet impact on a medium).

"Ink" is not limited to, unless otherwise specified, what are called ink, and may refer collectively to all liquids that can be used for image formation. Examples include what are referred to as a recording liquid, a fixing treatment liquid, and liquid. Other examples may include a DNA sample, a resist, a pattern material, and a resin.

An "image" is not limited to a two-dimensional one, and may include an image that is provided to a three-dimensionally formed body and an image that is formed by three-dimensionally sculpturing a solid body.

While the foregoing embodiments are applied to an image forming apparatus that uses roll paper, the embodiments are similarly applicable to an image forming apparatus that uses a sheet.

According to the present invention, the visibility of a test pattern formed by linear patterns can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording head in which a plurality of nozzles for discharging liquid droplets is arranged in a sub-scanning direction; and a pattern forming unit configured to form a test pattern used for positional deviation adjustment including a first pattern serving as a reference pattern and a second pattern serving as an adjustment pattern;

wherein the first pattern and the second pattern each extend for lengths in a direction parallel to the sub-scanning direction and separated by a distance in a main-scanning direction;

wherein the first pattern and the second pattern each include a not-printed portion with printed portions formed on both sides of the not-printed portion in the sub-scanning direction;

wherein the not-printed portions of the first and the second pattern are shifted from each other in the sub-scanning direction; and wherein the printed portions of the first and the second pattern overlap in the main-scanning direction for a majority of their respective lengths in the sub-scanning direction.

2. The image forming apparatus according to claim 1, wherein the not-printed portion of the first pattern and the not-printed portion of the second pattern are formed to be juxtaposed on opposite sides with a desired adjustment position therebetween in the nozzle arrangement direction.

3. The image forming apparatus according to claim 1, wherein the first pattern and the second pattern are formed by using the same number of nozzles.

4. The image forming apparatus according to claim 1, wherein the pattern forming unit forms the first pattern and the second pattern to be shifted from each other in the nozzle arrangement direction.

5. The image forming apparatus according to claim 1, wherein:

the image forming apparatus stores a plurality of pieces of pattern data on the first and second patterns which are mutually different in position of not-printed portions in the nozzle arrangement direction; and the pattern data is selectable to change the adjustment position.

6. The image forming apparatus according to claim 1, wherein the recording head comprises a plurality of the recording heads, and the first pattern and the second pattern are formed by different ones of the recording heads.

7. The image forming apparatus according to claim 1, wherein:

the recording head is movable in directions orthogonal to the nozzle arrangement direction;

the recording head forms the first pattern when moved in one direction; and the recording head forms the second pattern when moved in the other direction.

8. A method for forming a test pattern used for positional deviation adjustment performed in an image forming apparatus including a recording head that includes a nozzle row in which a plurality of nozzles for discharging liquid droplets are arranged in a sub-scanning direction, the method comprising:

forming a test pattern including a first pattern serving as a reference pattern and a second pattern serving as an adjustment pattern;

wherein the first pattern and the second pattern each extend for lengths in a direction parallel to the sub-scanning direction and separated by a distance in a main-scanning direction;

wherein the not-printed portions of the first and the second pattern each include a not-printed portion with printed portions formed on both sides of the not-printed portion in the sub-scanning direction;

wherein the not-printed portion of the first and the second pattern are shifted from each other in the nozzle arrangement sub-scanning direction; and wherein the printed portions of the first and second pattern overlap in the main-scanning direction for a majority of their respective lengths in the sub-scanning direction.

9. A computer program product comprising a non-transitory computer-readable medium containing a computer program that causes a computer to perform:

forming a test pattern including a first pattern serving as a reference pattern and a second pattern serving as an adjustment pattern;

wherein the first pattern and the second pattern each extend for lengths in a direction parallel to a sub-scanning direction and separated by a distance in a main-scanning direction;

wherein the not-printed portions of the first and the second patter each include a not-printed portion with printed portions formed on both sides of the not-printed portion in the sub-scanning direction;

wherein the not-printed portion of the first and the second pattern are shifted from each other in the sub-scanning direction; and wherein the printed portions of the first and second pattern overlap in the main-scanning direction for a majority of their respective lengths in the sub-scanning direction.

* * * * *